US009447679B2

(12) United States Patent
Xiao

(10) Patent No.: US 9,447,679 B2
(45) Date of Patent: Sep. 20, 2016

(54) INFLOW CONTROL VALVE AND DEVICE PRODUCING DISTINCT ACOUSTIC SIGNAL

(71) Applicant: Saudi Arabian Oil Company, Dhahran (SA)

(72) Inventor: Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 581 days.

(21) Appl. No.: 13/946,726

(22) Filed: Jul. 19, 2013

(65) Prior Publication Data

US 2015/0021015 A1 Jan. 22, 2015

(51) Int. Cl.

| | |
|---|---|
| ***E21B 47/14*** | (2006.01) |
| ***E21B 47/10*** | (2012.01) |
| ***E21B 47/12*** | (2012.01) |
| ***E21B 43/14*** | (2006.01) |
| ***E21B 34/08*** | (2006.01) |
| ***E21B 34/14*** | (2006.01) |

(52) U.S. Cl.

CPC ..... *E21B 47/14* (2013.01); *E21B 34/08* (2013.01); *E21B 34/14* (2013.01); *E21B 43/14* (2013.01); *E21B 47/102* (2013.01); *E21B 47/123* (2013.01)

(58) Field of Classification Search

CPC .... E21B 47/123; E21B 47/14; E21B 47/102; E21B 47/101; E21B 47/09; E21B 43/14; E21B 34/08; E21B 34/14

See application file for complete search history.

(56) References Cited

U.S. PATENT DOCUMENTS

| | | | | |
|---|---|---|---|---|
| 5,458,200 | A | 10/1995 | Lagerlef et al. | |
| 5,924,499 | A | 7/1999 | Birchak et al. | |
| 5,941,307 | A | 8/1999 | Tubel | |
| 5,944,109 | A | 8/1999 | Longbottom | |
| 5,995,449 | A | 11/1999 | Green et al. | |
| 6,021,095 | A | 2/2000 | Tubel et al. | |
| 6,281,489 | B1 * | 8/2001 | Tubel | E21B 47/00 166/250.15 |
| 6,604,584 | B2 | 8/2003 | Lerche et al. | |
| 6,994,162 | B2 | 2/2006 | Robison | |
| 7,295,933 | B2 | 11/2007 | Gysling et al. | |
| 7,423,931 | B2 | 9/2008 | Martin, II et al. | |
| 7,614,302 | B2 | 11/2009 | DiFoggio et al. | |
| 8,017,858 | B2 | 9/2011 | Mann | |
| 8,330,617 | B2 | 12/2012 | Chen et al. | |

(Continued)

FOREIGN PATENT DOCUMENTS

| | | | | |
|---|---|---|---|---|
| GB | 2399921 A * | 9/2004 | ..... | E21B 47/182 |
| WO | 0163804 A1 | 8/2001 | | |

OTHER PUBLICATIONS

Molenaar, M.M., et al., "First Downhole Application of Distributed Acoustic Sensing (DAS) for Hydraulic Fracturing Monitoring and Diagnostics," SPE Hydraulic Fracturing Tech Conf and Exhibition, Jan. 24-26, 2011, SPE 140561, Society of Petroleum Engineers.

(Continued)

*Primary Examiner* — Jennifer H Gay

(74) *Attorney, Agent, or Firm* — Bracewell LLP; Constance G. Rhebergen; Kevin R. Tamm

(57) ABSTRACT

Systems and methods for generating and monitoring an acoustic response to particular fluid flow conditions in a wellbore include incorporating a sound-producing element into each inflow control device installed in a wellbore. Each of the sound-producing elements generates an acoustic signature that is readily identifiable from each other sound-producing element installed in the wellbore.

25 Claims, 5 Drawing Sheets

(56) References Cited

U.S. PATENT DOCUMENTS

| | | | | |
|---|---|---|---|---|
| 2004/0140092 | A1* | 7/2004 | Robison | E21B 29/02 166/255.1 |
| 2005/0168349 | A1* | 8/2005 | Huang | E21B 47/182 340/854.3 |
| 2007/0204995 | A1* | 9/2007 | Hofman | E21B 34/14 166/308.1 |
| 2008/0314590 | A1* | 12/2008 | Patel | E21B 34/06 166/278 |
| 2009/0101432 | A1 | 4/2009 | Hsu | |
| 2009/0288838 | A1* | 11/2009 | Richards | E21B 34/063 166/374 |
| 2011/0122727 | A1* | 5/2011 | Gleitman | E21B 36/02 367/81 |
| 2011/0229071 | A1 | 9/2011 | Vincelette et al. | |
| 2012/0011990 | A1 | 1/2012 | Mann | |
| 2012/0111104 | A1 | 5/2012 | Taverner et al. | |
| 2012/0111560 | A1 | 5/2012 | Hill et al. | |
| 2012/0146805 | A1 | 6/2012 | Vick, Jr. et al. | |
| 2014/0083685 | A1* | 3/2014 | Tips | E21B 47/123 166/250.01 |
| 2014/0126331 | A1* | 5/2014 | Skinner | G01V 1/40 367/82 |
| 2014/0216754 | A1* | 8/2014 | Richard | E21B 43/08 166/373 |
| 2015/0021015 | A1* | 1/2015 | Xiao | E21B 47/123 166/250.01 |
| 2015/0107829 | A1* | 4/2015 | Themig | E21B 34/14 166/255.1 |

OTHER PUBLICATIONS

Statoil. K.J., et al.,"Distributed Acoustic Sensing—A New Way of Listening to Your Well/Reservoir," SPE Intelligent Energy Int, Mar. 27-29, 2012, SPE 149602, Society of Petroleum Engineers.

PCT International Search Report and The Written Opinion of the International Searching Authority dated Oct. 23, 2015; International Application No. PCT/US2014/046934; International Filing Date: Jul. 17, 2014.

PCT Partial International Search Report of the International Searching Authority dated Aug. 3, 2015; International Application No. PCT/US2014/046934; International Filing Date: Jul. 17, 2014.

* cited by examiner

INFLOW CONTROL VALVE AND DEVICE PRODUCING DISTINCT ACOUSTIC SIGNAL

BACKGROUND OF THE INVENTION

1. Field of the Invention

The present invention relates to operations in a wellbore associated with the production of hydrocarbons. More specifically, the invention relates to a system and method of monitoring and controlling the inflow of a production fluid into a wellbore and/or the injection of fluids into a subterranean formation through the wellbore.

2. Description of the Related Art

Often in the recovery of hydrocarbons from subterranean formations, wellbores are drilled with highly deviated or horizontal portions that extend through a number of separate hydrocarbon-bearing production zones. Each of the separate production zones may have distinct characteristics such as pressure, porosity and water content, which, in some instances, may contribute to undesirable production patterns. For example, if not properly managed, a first production zone with a higher pressure may deplete earlier than a second, adjacent production zone with a lower pressure. Since nearly depleted production zones often produce unwanted water that can impede the recovery of hydrocarbon containing fluids, permitting the first production zone to deplete earlier than the second production zone may inhibit production from the second production zone and impair the overall recovery of hydrocarbons from the wellbore.

One technology that has developed to manage the inflow of fluids from various production zones involves the use of downhole inflow control tools such as inflow control devices (ICDs) and inflow control valves (ICVs). An ICD is a generally passive tool that is provided to increase the resistance to flow at a particular downhole location. For example, a helix type ICD requires fluids flowing into a production tubing to first pass through a helical flow channel within the ICD. Friction associated with flow through the helical flow channel induces a desired flow rate. Similarly, nozzle-type ICDs require fluid to first pass through a tapered passage to induce a desired flow rate, and ICVs generally require fluid to first pass through a flow channel of a size and shape that is adjustable from the surface. Thus, a desired flow distribution along a length of production tubing may be achieved by installing an appropriate number and type of ICDs and ICVs to the production tubing.

One method of monitoring the production patterns of a wellbore involves monitoring the acoustic response to fluid flowing through a wellbore. Some fluid flows, however, do not produce robust or readily identifiable acoustic signals, and thus, it is often difficult to discern whether fluid is flowing through a particular region of the wellbore.

SUMMARY OF THE INVENTION

Described herein are systems and methods for generating and monitoring an acoustic response to particular fluid flow conditions in a wellbore. A sound-producing element is incorporated into each inflow control tool installed in a wellbore, and each of the sound-producing elements generates an acoustic signal having a signature that is readily identifiable from each other sound-producing element installed in the wellbore.

According to one aspect of the invention, a system for use in a wellbore extending through a subterranean formation includes first and second inflow control tools disposed in the wellbore and operable to regulate fluid flow into the wellbore. A first sound-producing element is operable to generate a first acoustic signal in response to fluid flow through the first inflow control tool, and the first acoustic signal defines a first acoustic signature. A second sound-producing element is operable to generate a second acoustic signal in response to fluid flow through the second inflow control tool, and the second acoustic signal defines a second acoustic signature that is distinguishable from the first acoustic signature. The first acoustic signal is operable to be distinguishable from the second acoustic signal. The system also includes a measurement device operable to detect the first and second acoustic signals and to distinguish between the first and second acoustic signatures.

In some embodiments, the first sound-producing element is disposed within a flow path defined through the first inflow control tool, and in other embodiments, the first sound-producing element is disposed at a downstream location with respect to the first inflow control tool. In some embodiments the first sound-producing element includes a structure induced to vibrate in response to fluid flow through the first inflow control tool, and the first sound-producing element includes at least one of a whistle, a bell, a Helmholtz resonator, and a rotating wheel.

In some embodiments the system further includes an optical waveguide extending into the wellbore and coupled to the measurement device, and the optical waveguide is subject to changes in response to the first and second acoustic signals that are detectable by the measurement device. In some embodiments, the measurement device is disposed at a surface location remote from the first and second sound-producing elements. In some embodiments, the system further includes an isolation member operable to isolate a first annular region of the wellbore from a second annular region of the wellbore, and the first inflow control tool is disposed in the first annular region and the second inflow control tool is disposed in the second annular region. In some embodiments, the first and second inflow control tools are disposed on upstream and downstream locations with respect to one another on a production tubing extending through the wellbore. In some embodiments, the first and second inflow control tools are disposed within a substantially horizontal portion of the wellbore. In some embodiments, the at least one of the first and second inflow control toots defines a helical flow path therethrough.

According to another aspect of the invention, a method of monitoring fluid flow in a wellbore includes (i) installing first and second inflow control tools in corresponding first and second annular regions within the wellbore, (ii) installing first and second sound-producing elements in the wellbore, each of the first and second sound-producing element operable to actively generate a respective first and second acoustic signals in response to fluid flowing through a respective corresponding one of the first and second inflow control tools, (iii) producing a production fluid from the wellbore through at least one of the first and second inflow control tools, (iv) detecting at least one of the first and second acoustic signals, and (v) identifying which of the first and second acoustic signals was detected to determine through which of the first and second inflow control tools the production fluid was produced.

In some embodiments, the method further includes determining a frequency of the at least one of the first and second acoustic signals to determine a flow rate through at least one of the first and second inflow control tools. In some embodiments, the method further includes fluidly isolating the first and second annular regions. In some embodiments, the method further includes deploying an optical waveguide into the wellbore, and in some embodiments, the step of detecting the at least one of the first and second acoustic signals is achieved by detecting changes in strain in the optical waveguide induced by the at least one of the first and second acoustic signals. In some embodiments, the method further includes removing the optical waveguide from the wellbore.

According to another aspect of the invention, a method of monitoring fluid flow in a wellbore includes (i) producing a production fluid from the wellbore through a first inflow control tool disposed in a first annular region within the wellbore, (ii) actively generating a first acoustic signal in response to the production fluid flowing through the first inflow control tool, (iii) detecting the first acoustic signal and (iv) distinguishing the first acoustic signal from a second acoustic signal, wherein the second acoustic signal is actively generated in response to the production fluid flowing through a second inflow control tool disposed in a second annular region within the wellbore.

In some embodiments, the method further includes generating a report indicating that the first acoustic signal was detected and that production fluid was flowing through the first inflow control tool, and in some embodiments, the method further includes detecting the second acoustic signal and indicating on the report that the first and second acoustic signals were detected and that production fluid was flowing through the first and second inflow control tools. In some embodiments, the method further includes installing the first and second sound-producing elements in the wellbore such that each one of the first and second sound-producing elements is operable to actively generate one of the respective first and second acoustic signals in response to fluid flowing through the respective corresponding one of the first and second inflow control tools.

According to another aspect of the invention, an inflow control tool monitoring system for use with fluid flow in conjunction with a wellbore extending into a subterranean formation includes an inflow control tool operable to be disposed in the wellbore and operable to regulate fluid flow through the wellbore. The inflow control tool has an inflow control tool housing, and the inflow control tool housing is operable to be installed in line with production tubing. A restrictive passage is defined within the inflow control tool housing, and the restrictive passage is operable to regulate the fluid flow. The inflow control tool has a sound-producing element disposed within the inflow control tool housing, and the sound-producing, element is operable to generate a first acoustic signal in response to fluid flow through the inflow control tool.

In some embodiments, the inflow control monitoring system further includes a distributed sensing subsystem, and the distributed sensing subsystem is capable of monitoring the first acoustic signal. In some embodiments, the sensing subsystem comprises a measurement device and an optical waveguide.

In some embodiments, the inflow control tool is selected from the group consisting of helical type, valve type, nozzle type and combinations of the same. In some embodiments, the sound-producing element is mounted to an interior wall of the inflow control tool housing. In some embodiments, the inflow control tool is valve type, and the inflow control tool further includes a sleeve disposed within the inflow control tool housing, and the sound-producing element is mounted to an interior wall of the sleeve.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
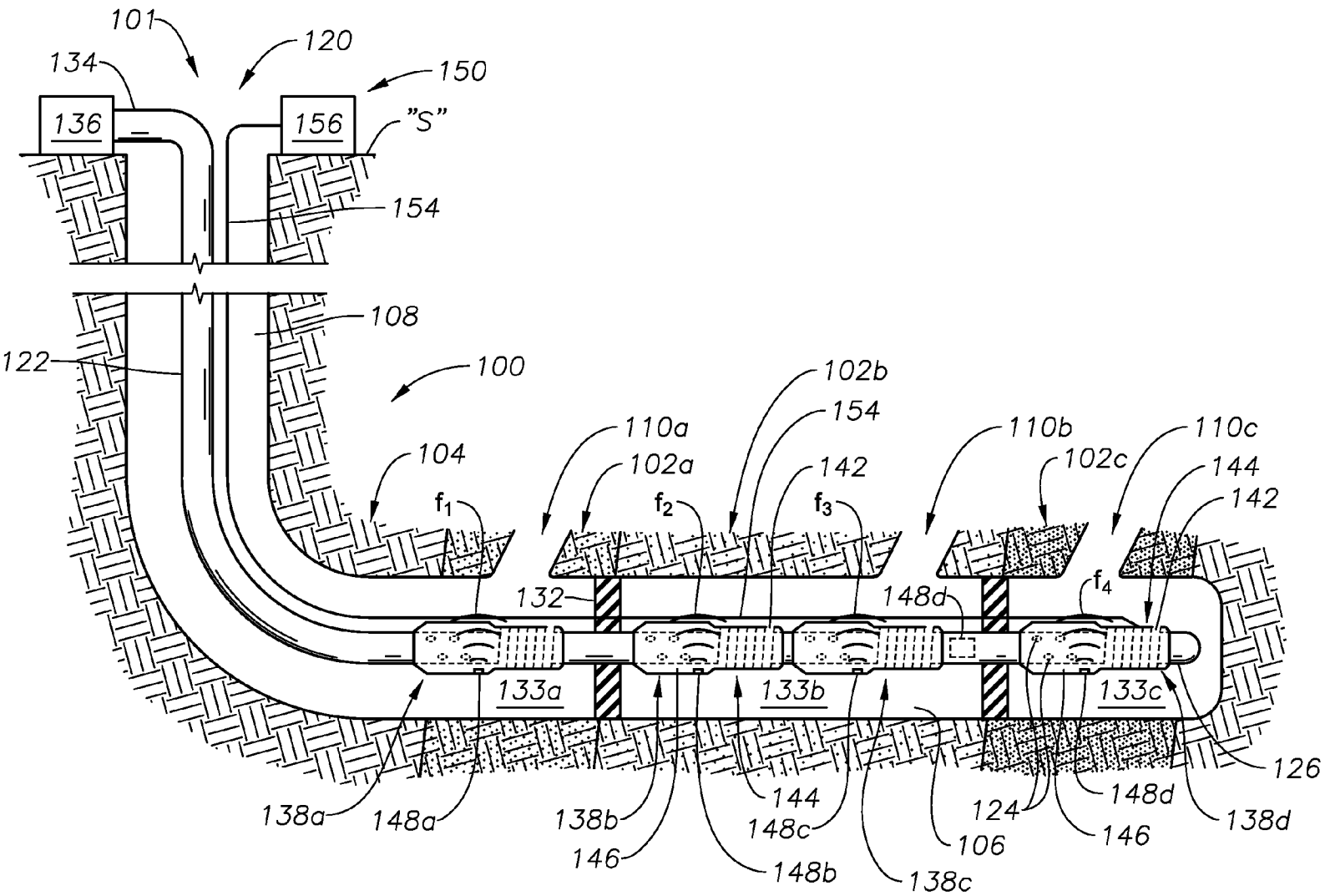
FIG. 1 is a schematic cross-sectional view of a wellbore extending through a plurality of production zones and having a plurality of inflow control tools installed therein in accordance with the present invention.

Shown in side sectional view in FIG. 1 is one example embodiment including wellbore 100 extending through three production zones 102*a*, 102*b* and 102*c* defined in subterranean formation 104. Production zones 102*a*, 102*b* and 102*c* include oil or some other hydrocarbon containing fluid that is produced through wellbore 100. As will be appreciated by one skilled in the art, although wellbore 100 is described herein as being employed for the extraction of fluids from subterranean formation 104, in other embodiments (not shown), wellbore 100 is equipped to permit injection of fluids into subterranean formation 104, e.g., in a fracturing operation carried out in preparation for hydrocarbon extraction. Wellbore 100 includes substantially horizontal portion 106 that intersects production zones 102*a*, 102*b* and 102*c*, and a substantially vertical portion 108. Lateral branches 110*a*, 110*b*, and 110*c* extend from substantially horizontal portion 106 into respective production zones 102*a*, 102*b*, 102*c*, and facilitate the recovery of hydrocarbon containing fluids therefrom. Substantially vertical portion 108 extends to surface location "S" that is accessible by operators for monitoring, and controlling equipment installed within wellbore 100. In other embodiments (not shown), an orientation of wellbore 100 is entirely substantially vertical, or deviated to less than horizontal.

Monitoring system 120 for monitoring and/or controlling the flow of fluids in wellbore 100 includes production tubing 122 extending from surface location "S" through substantially horizontal portion 106 of wellbore 100. Production tubing 122 includes apertures 124 defined at a lower end 126 thereof, which permit the passage of fluids between an interior and an exterior of production tubing 122. In this example embodiment, monitoring system 120 includes isolation members 132 operable to isolate annular regions 133*a*, 133*b* and 133*c* from one another. In this example embodiment, isolation members 132 are constructed as swellable packers extending around the exterior of production tubing 122 and engaging an annular wall of subterranean formation 104. Isolation members 132 serve to isolate production zones 102*a*, 1021 and 102*c* from one another within wellbore 100 such that fluids originating from one of production zones 102*a*, 102*b* and 102*c* flow into a respective corresponding annular region 133*a*, 133*b*, 133*c*. As described in greater detail below, monitoring system 120 enables a determination to be made regarding which production zones 102*a*, 102*b* and 102*c* are producing production fluids, and which production zones 102*a*, 102*b* and 102*c* are depleted. Surface flowline 134 couples production tubing 122 to a reservoir 136 for collecting fluids recovered from subterranean formation 104.

A plurality of inflow control tools 138*a*, 138*b*, 138*c* and 138*d*, collectively 138, are installed along lower end 126 of production tubing 122. Inflow control tool 138*d* is disposed at an upstream location on production tubing 122 with respect to inflow control tools 138*a*, 138*b*, 138*c*, and inflow control tool 138*a* is disposed at a downstream location on production tubing 122 with respect to inflow control tools 138*b*, 138*c*, 138*d*. As depicted in FIG. 1, each inflow control tool 138 is depicted schematically as a helix type ICD for controlling the inflow of fluids into the interior of production tubing 122. It will be appreciated by those skilled in the art that in other embodiments (not shown), another type of ICD, an ICV, or any combination thereof, is provided as the plurality of inflow control tools 138. Each of inflow control tools 138 includes an inlet 142 leading to a helical channel 144. Helical channel 144 terminates in a chamber 146 substantially surrounding a subset of apertures 124 defined in production tubing 122. Inflow control tools 138 are arranged such that fluid flowing into production tubing 122 through apertures 124 must first flow through helical channel 144, and helical channel 144 imparts a frictional force to the fluid flowing therethrough. The amount of frictional force imparted to the fluid is partially dependent on a length of helical channel 144.

Each of inflow control tools 138*a*, 138*b*, 138*c* and 138*d* include a respective corresponding sound-producing element 148*a*, 148*b*, 148*c* and 148*d*, collectively 148. Sound-producing elements 148 are responsive to fluid flow through respective inflow control tool 138 to actively produce one of distinctive acoustic signals $f_1$, $f_2$, $f_3$ and $f_4$ that is readily identifiable with respect to each other acoustic signal $f_1$, $f_2$, $f_3$ and $f_4$. For example, in some embodiments, a predefined frequency range is associated with each of acoustic signals $f_1$, $f_2$, $f_3$ and $f_4$ that is distinct for each of acoustic signals $f_1$, $f_2$, $f_3$ and $f_4$. Each of sound-producing elements 148 is disposed within each of corresponding inflow control tools 138 as described in greater detail below. Thus, only fluid flowing through a particular inflow control tool 138 contributes to a particular acoustic signal $f_1$, $f_2$, $f_3$, $f_4$ generated. Alternate locations are envisioned for sound producing elements 148 with respect to corresponding inflow control tools 138. For example, in other embodiments, sound-producing element 148*d* is disposed at a downstream location in production tubing 122 with respect to corresponding inflow control tool 138*d* (as depicted in phantom). In this alternate location, sound-producing element 148*d* is exposed exclusively to fluids entering production tubing 122 from corresponding inflow control tool 138*d* disposed downstream of sound-producing element 148*d*.

Monitoring system 120 includes a sensing subsystem 150, one exemplary embodiment being a distributed acoustic sensing (DAS) subsystem. Sensing subsystem 150 is operable to detect acoustic signals $f_1$, $f_2$, $f_3$, $f_4$ and operable to distinguish between acoustic signals $f_1$, $f_2$, $f_3$, $f_4$. Sensing subsystem 150 includes optical waveguide 154 that extends into wellbore 100. In this example embodiment, optical waveguide 154 is constructed of an optic fiber, and is coupled to measurement device 156 disposed at surface location "S." Measurement device 156 is operable to measure disturbances in scattered light propagated within optical waveguide 154. In some embodiments, the disturbances in the scattered light are generated by strain changes in optical waveguide 154 induced by acoustic signals such as acoustic signals $f_1$, $f_2$, $f_3$ and $f_4$. Measurement device 156 is operable to detect, distinguish and interpret the strain changes to determine a frequency of acoustic signals $f_1$, $f_2$, $f_3$ and $f_4$.

Figure 2:
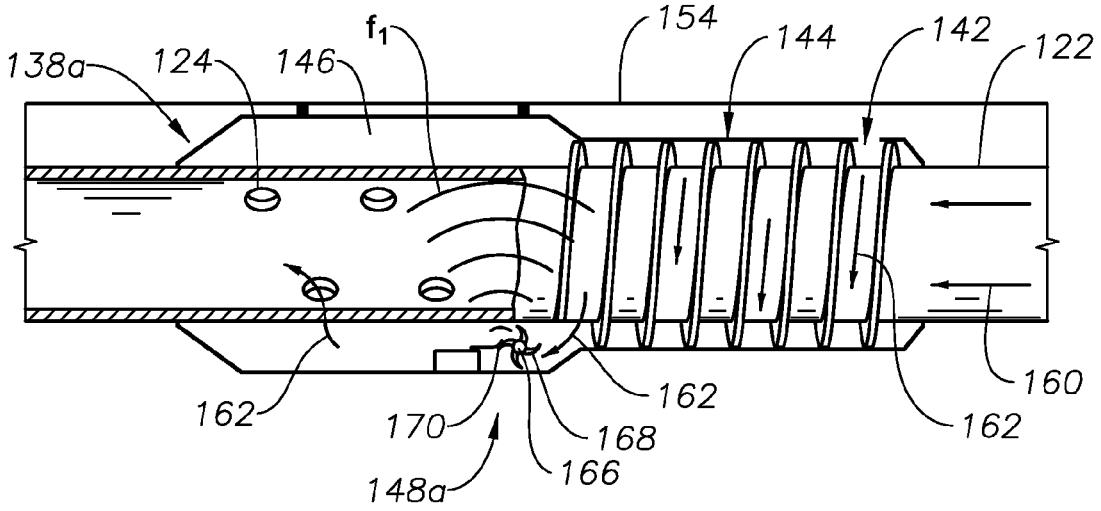
FIG. 2 is an enlarged cross sectional view of a flow channel established through one of the inflow control tools of FIG. 1, which contains one embodiment of a sound-producing element therein in accordance with the present invention.

Referring now to FIG. 2, inflow control tool 138*a* is described in greater detail. Inflow control tool 138*a* is disposed in-line with production tubing 122, which carries a flow of fluid 160, one exemplary embodiment being hydrocarbon containing production fluids originating from upstream production zones 102*b* and 102*c* (FIG. 1). A production fluid 162 from production zone 102*a*, (FIG. 1) enters production tubing 122 through apertures 124. Before passing through apertures 124, production fluid 162 must pass though inlet 142, helical channel 144 and chamber 146, defining an interior flow path of inflow control tool 138*a*. Sound-producing element 148*a* is disposed within the interior flow path of inflow control tool 138*a*, and is thus responsive only to the flow of fluid 162 originating from production zone 102*a*. In this example embodiment, the flow of fluid 160 through production tubing 122 does not contribute to the operation of sound-producing element 148*a*.

Sound-producing element 148*a* includes rotating wheel 166 having a plurality of blades 168 protruding therefrom. Blades 168 extend into the path of fluid 162 such that rotating wheel 166 is induced to rotate by the flow of fluid 162 therepast. A flexible beam 170 extends into the path of blades 168 such that blades 168 engage flexible beam 170 and thereby generate acoustic signal $f_1$. The frequency at which blades 168 engage flexible beam 170, and thus the frequency of acoustic signal $f_1$, is dependent at least partially on the flow rate of fluid 162. Acoustic signal $f_1$ travels to optical waveguide 154 and generates strain changes or other disturbances in optical waveguide 154, which are detectable by measurement device 156 (FIG. 1). Flexible beam 170 is constructed of one of various metals or plastics to generate a distinguishable acoustic signal 1.

Figure 3:
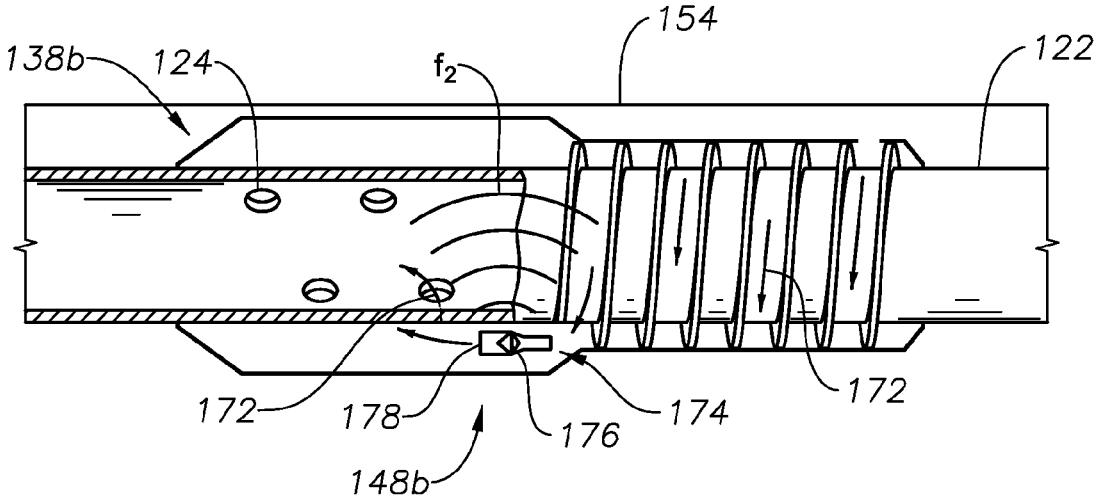
FIG. 3 is a cross-sectional view of a flow channel established through another one of the inflow control tools of FIG. 1, which contains an alternate embodiment of a sound-producing element in accordance with the present invention.

Referring now to FIG. 3, inflow control tool 138*b* includes sound-producing element 148*b* that is responsive to a flow of fluid 172 through inflow control tool 138*b* to generate acoustic signal $f_2$. Sound-producing element 138*b* is configured as a whistle including an inlet 174 positioned to receive at least a portion of fluid 172 flowing through inflow control tool 138*b*. An edge or labium 176 in is positioned in the path of fluid 172 and vibrates in response to the flow of fluid 172 therepast. Fluid 172 exits sound-producing element 148*b* through an outlet 178 and then flows into production tubing 122 through apertures 124. The vibration of labium 176 generates acoustic signal $f_2$, which is distinguishable from acoustic signal $f_1$. The flow rate of fluid 172 through inflow control tool 138*b* is determinable by detecting and analyzing acoustic signal $f_2$ at multiple locations along the flow path of fluid 172, e.g., at multiple locations both upstream and downstream of sound-producing element 148. In some embodiments, sound-producing element 148 is a commercially available windstorm whistle.

Sound-producing elements 148*c* and 148*d* (FIG. 1) are configured to generate acoustic signals $f_3$ and $f_4$ that are distinguishable from one another as well as distinguishable from acoustic signals $f_1$ and $f_2$. In some embodiments, sound-producing elements 148*c* and 148*d* are bells (see FIG. 5) having a clapper responsive to fluid flow and a plate or other structure (not shown) configured to vibrate in response to being struck by the clapper. In other embodiments, sound-producing elements 148*c* and 148*d* are Helmholtz resonators, which produce an acoustic signal in response to fluid resonance within a cavity (see FIG. 5) due to fluid flow across an opening to the cavity. In other embodiments, sound-producing elements 148*c* and 148*d* are of a similar type as sound-producing elements 148*a* and 148*b*. For example, in some embodiments, sound-producing element 148*c* includes rotating wheel 166 with blades 168 operable to engage a beam 170 in a manner similar to sound-producing element 148*a* (see FIG. 2). Sound-producing element 148*c*, however, includes a different number of blades 168 such that acoustic signal $f_3$ is distinguishable from acoustic signal $f_1$.

Figure 4:
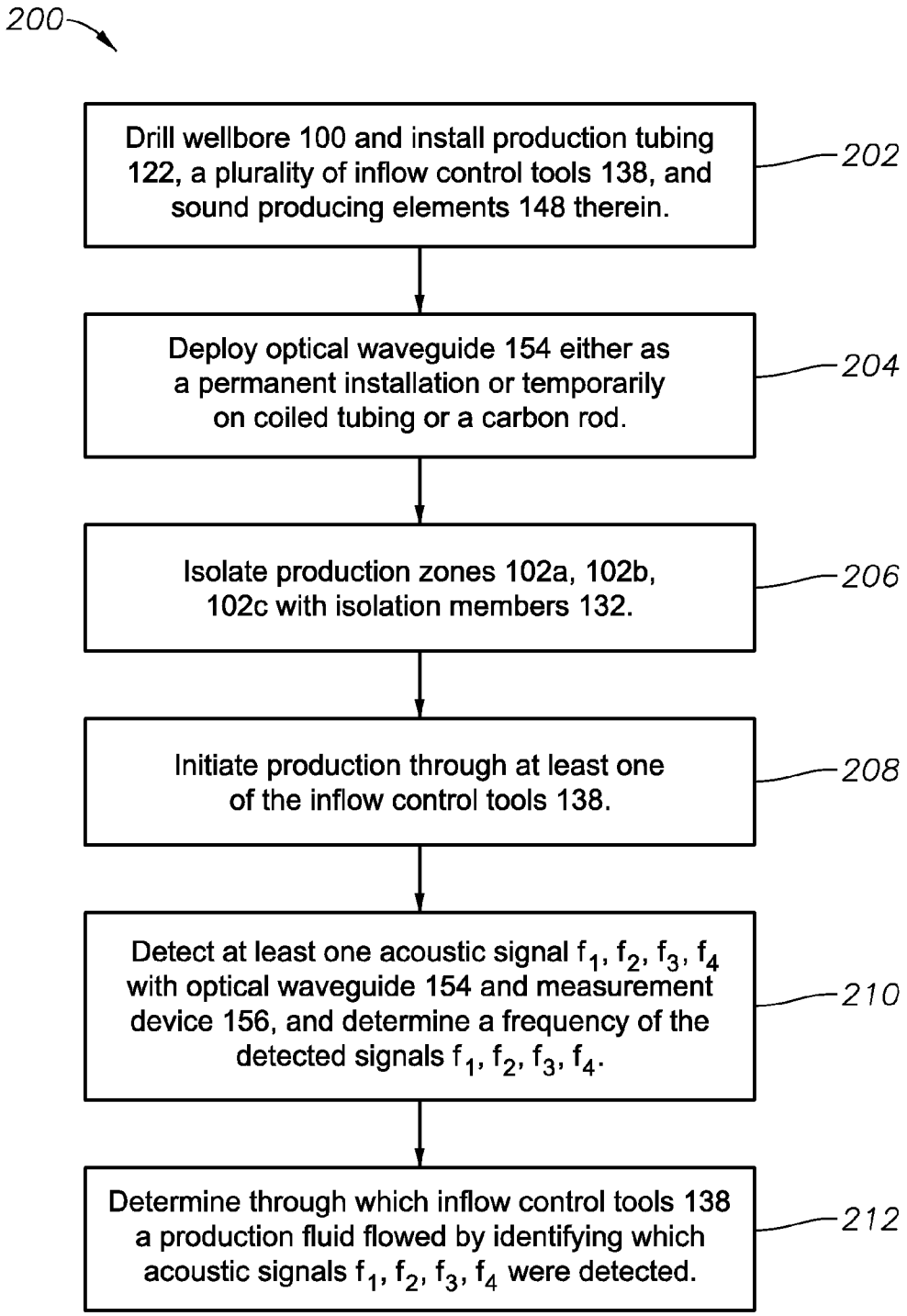
FIG. 4 is a flow diagram illustrating an example embodiment of an operational procedure in accordance with the present invention.

Referring now to FIG. 4, one example embodiment of a method 200 for use of monitoring system 120 (see FIG. 1) is described. Initially, wellbore 100 is drilled, and production tubing 122, inflow control tools 138 and respective corresponding sound-producing elements 148 are installed (step 202). Optical waveguide 154 is deployed either as a permanent installation, e.g., during the installation of inflow control tools 138, or is temporarily deployed, e.g., conveyed into wellbore 100 (step 204) with coiled tubing or a carbon rod (not shown) and removed subsequent to use. Production zones 102*a*, 102*b* and 102*c* are isolated by deploying isolation members 132 (step 206). Production is initiated such that hydrocarbon fluids originating from at least one of production zones 102*a*, 102*b* and 102*c* flow through at least one of inflow control tools 138 (step 208).

Next, measurement device 156 and optical waveguide 154 are employed to detect acoustic signals $f_1$, $f_2$, $f_3$, $f_4$ generated in wellbore 100 (step 210). Once acoustic signals $f_1$, $f_2$, $f_3$, $f_4$ are detected, a determination is made (step 212) and a corresponding report is generated regarding fluid flow conditions in wellbore 100 based on the characteristics of acoustic signals $f_1$, $f_2$, $f_3$, $f_4$ detected. For example, if each of acoustic signals $f_1$, $f_2$, $f_3$ and $f_4$ are detected, it is determined and reported that that fluid is flowing from each of production zones 102*a*, 102*b*, 102*c* through each of inflow control tools 148. If acoustic signals $f_1$, $f_2$, and $f_3$ are detected, but acoustic signal $f_4$ is not detected, it is determined and reported that fluid is flowing from production zones 102*a* and 102*b* through inflow control tools 138*a*, 138*b* and 138*c*, but not from production zone 102*c* through inflow control tool 138*d*. This condition is an indication that production zone 102*c* is depleted, inflow control tool 138*d* is malfunctioning, or inflow control tool 138*d* is set to a non-operational state. In some embodiments, a frequency of at least one acoustic signals $f_1$, $f_2$, $f_3$, $f_4$ is determined (step 210), and a flow rate is determined. In some embodiments, acoustic signals acoustic signals $f_1$, $f_2$, $f_3$, $f_4$ are detected at multiple locations both upstream and downstream of respective corresponding sound-producing element 148*a*, 148*b*, 148*c* and 148*d*.

Figure 5:
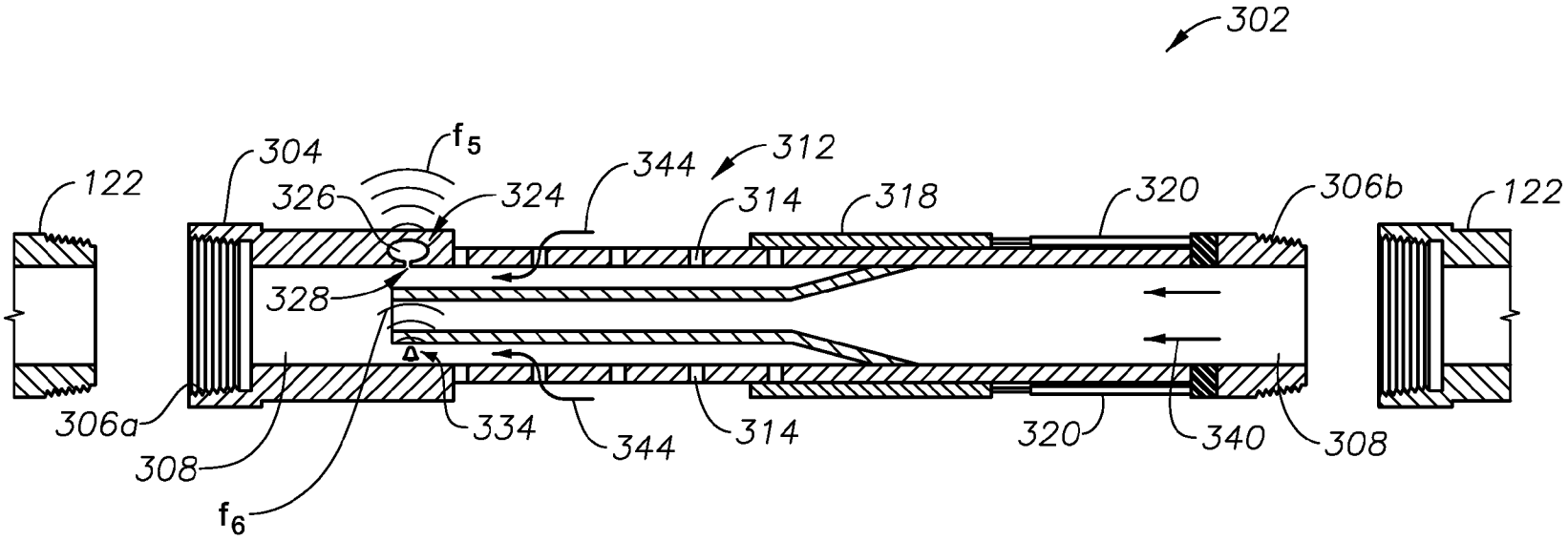
FIG. 5 is a schematic cross sectional view of a valve type inflow control tool (an ICV) schematically illustrating various alternate embodiments of sound-producing elements in accordance with the present invention, and FIG. 6 similarly shows a schematic cross sectional view of a valve type ICV with alternatively located sound-producing elements.
Figure 6:
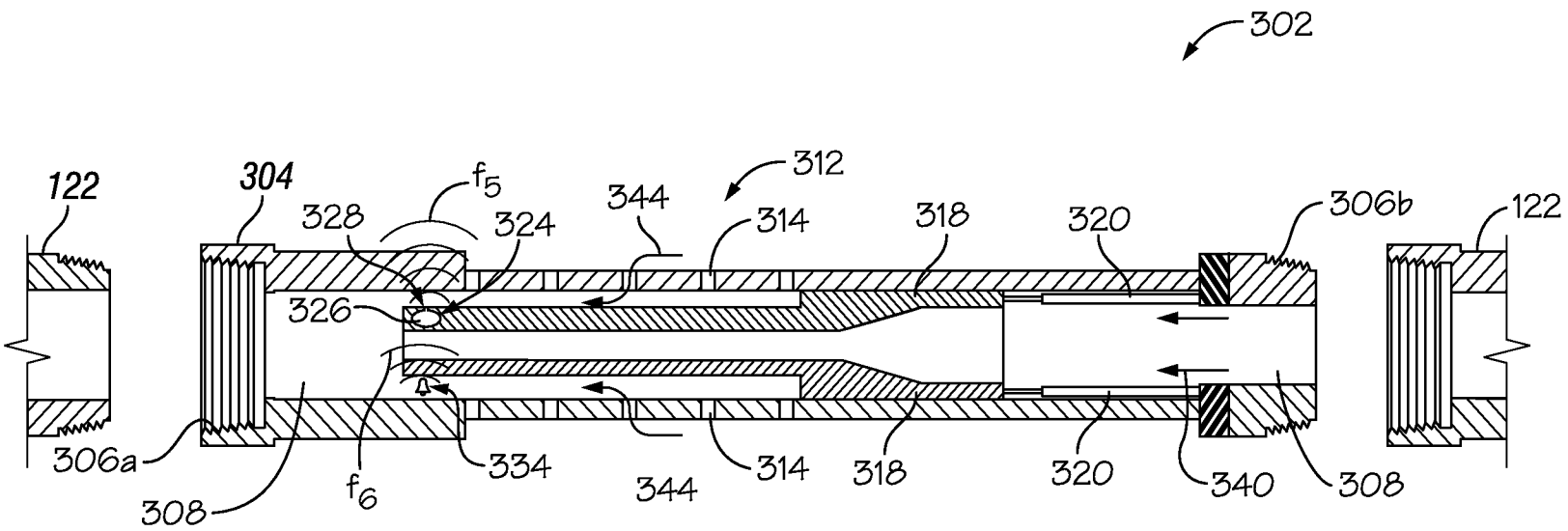

Referring now to FIG. 5, one example of a valve type inflow control tool 302 is illustrated. Valve type inflow control tool 302 is operable to be installed in line with production tubing 122 and operable to regulate fluid flow through wellbore 100 (FIG. 1). An inflow control tool housing 304 includes connectors 306*a*, 306*b* at each longitudinal end thereof for securement of valve type inflow control tool 302 to production tubing 122. In the illustrated exemplary embodiment, connectors 306*a*, 306*b* are threaded connectors. In other embodiments, connectors 306*a*, 306*b* are bayonet style connectors or other connectors known in the art. When connectors 306*a*, 306*b* are secured to production tubing 122, an interior flow channel 308 extending longitudinally through valve type inflow control tool 302 fluidly communicates with the interior of production tubing 122.

Restrictive passage 312 is provided within inflow control tool housing 304 and is operable to regulate fluid flow between an exterior of inflow control tool housing 304 and interior flow channel 308. Apertures 314 extend laterally through inflow control tool housing 304 to selectively provide fluid communication therethrough. A closing element 318 is operatively coupled to an actuator 320 for selectively covering a selected number of apertures 314 to selectively interrupt fluid flow through apertures 314. In the illustrated embodiment, closing element 318 is a longitudinally sliding sleeve, and actuator 320 includes a pair of pistons selectively operable to slide closing element 318 over apertures 314. In other embodiments (not shown) closing element 318 and actuator 320 are disposed within an interior of inflow control tool housing 304, or configured as any alternate type of valve members such as ball valves, gate valves, or other configurations known in the art. By covering a greater number of apertures 314 resistance to flow through restrictive passage 312 is increased.

As illustrated schematically, sound-producing element 324 is disposed within inflow control tool housing 304, and is operable to generate acoustic signal $f_5$ in response to fluid flow through valve type inflow control tool 302. Sound-producing element 324 is configured as a Helmholtz resonator which produces acoustic signal $f_5$ in response to fluid resonance within cavity 326 due to fluid flow across opening 328 to cavity 326. Also depicted schematically is sound-producing element 334 for use in conjunction with, or in the alternative to, sound-producing element 324. Sound-producing element 334 is configured as a bell, which produces acoustic signal $f_6$ in response to fluid flow through valve type inflow control tool 302. Sound-producing elements 324 and 334 are mounted to an interior wall of the inflow control tool housing 304. Alternatively, in some embodiments where closing element 318 is disposed within an interior of inflow control tool housing 304, sound producing elements 324, 334 are mounted to the longitudinally sliding sleeve of closing element 318.

In one example embodiment of use, valve type inflow control tool 302 receives a flow of fluid 340 from upstream production tubing 122. Fluid 340 flows through interior flow channel 308 without contributing to acoustic signals $f_5$ and $f_6$. When closing element 318 is in a retracted position as illustrated, a flow of fluid 344 enters inflow control tool housing 304 through apertures 314. The flow of fluid 344 induces sound-producing elements 324, 334 to generate acoustic signals $f_5$ and $f_6$. If it is desired to slow or stop the inflow of fluid 344 into valve type inflow control tool 302, actuators 320 are employed to move closing element 318 over a greater number of apertures 314. A change or cessation of acoustic signals $f_5$ and $f_6$ is detected by measurement device 156 (FIG. 1), confirming that closing element 318 is property in position over apertures 314. Conversely, if it is desired to speed the inflow of fluid 344 into valve type inflow control tool 302, actuators 320 are employed to retract closing element 318 from apertures 314. Detection of acoustic signals $f_5$ and $f_6$ provides confirmation that closing element 318 is properly retracted from apertures 314.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A monitoring system for use in a wellbore extending through a subterranean formation, the system, comprising:

first and second inflow control tools disposed in the wellbore and operable to regulate fluid flow into the wellbore;

a first sound-producing element operable to generate a first acoustic signal in response to fluid flow through the first inflow control tool, the first sound-producing element disposed in an interior flow path of the first inflow control tool proximate a fluid inlet of the first inflow control tool, wherein the first acoustic signal defines a first acoustic signature, and wherein the first sound-producing element is responsive only to the fluid flow from the first inflow control tool;

a second sound-producing element operable to generate a second acoustic signal in response to fluid flow through the second inflow control tool, the second sound-producing element disposed in an interior flow path of the second inflow control tool proximate a fluid inlet of the second inflow control tool, wherein the second acoustic signal defines a second acoustic signature that is distinguishable from the first acoustic signature, and wherein the second sound-producing element is responsive only to the fluid flow from the second inflow control tool; and a sensing subsystem operable to detect the first and second acoustic signals and operable to distinguish between the first and second acoustic signatures.

2. The monitoring system of claim 1, wherein the first sound-producing element is disposed at a downstream location with respect to the fluid inlet of the first inflow control tool.

3. The monitoring system of claim 1, wherein the first sound-producing element comprises a structure induced to vibrate in response to fluid flow through the first inflow control tool.

4. The monitoring system of claim 3, wherein the first sound-producing element is selected from the group consisting of:

a whistle;

a bell;

a Helmholtz resonator; and a rotating wheel.

5. The monitoring system of claim 1, wherein the sensing subsystem comprises a measurement device and an optical waveguide extending into the wellbore and coupled to the measurement device, wherein the optical waveguide is subject to changes in response to the first and second acoustic signals that are detectable by the measurement device.

6. The monitoring system of claim 5, wherein the measurement device is disposed at a surface location remote from the first and second sound-producing elements.

7. The monitoring system of claim 1, further comprising an isolation member operable to isolate a first annular region of the wellbore from a second annular region of the wellbore, wherein the first inflow control tool is disposed in the first annular region and the second inflow control tool is disposed in the second annular region.

8. The monitoring system of claim 1, wherein the first and second inflow control tools are disposed on upstream and downstream locations with respect to one another on a production tubing extending through the wellbore.

9. The monitoring system of claim 1, wherein the first and second inflow control tools are disposed within a substantially horizontal portion of the wellbore.

10. The monitoring system according to claim 1, wherein at least one of the first and second inflow control tools defines a helical flow path therethrough.

11. A method of monitoring fluid flow in a wellbore, the method comprising:

(i) installing first and second inflow control tools in corresponding first and second annular regions within the wellbore;

(ii) installing first and second sound-producing elements in the wellbore, each of the first and second sound-producing element operable to actively generate a respective first and second acoustic signals in response to fluid flowing through a respective corresponding one of the first and second inflow control tools, the first acoustic signal operable to be distinguishable from the second acoustic signal, wherein the first sound-producing element is responsive only to the fluid flow from the first inflow control tool, and wherein the second sound-producing element is responsive only to the fluid flow from the second inflow control tool;

(iii) producing a production fluid from the wellbore through at least one of the first and second inflow control tools;

(iv) detecting at least one of the first and second acoustic signals; and (v) identifying which of the first and second acoustic signals was detected to determine through which of the first and second inflow control tools the production fluid was produced.

12. The method of claim 11, further comprising determining a frequency of the at least one of the first and second acoustic signals to determine a flow rate through at least one of the first and second inflow control tools.

13. The method of claim 11, further comprising fluidly isolating the first and second annular regions.

14. The method of claim 11, further comprising deploying an optical waveguide into the wellbore, and wherein the step of detecting the at least one of the first and second acoustic signals is achieved by detecting changes in strain in the optical waveguide induced by the at least one of the first and second acoustic signals.

15. The method of claim 14, further comprising removing the optical waveguide from the wellbore.

16. A method of monitoring fluid flow in a wellbore, the method comprising:

(i) producing a production fluid from the wellbore through a first inflow control tool disposed in a first annular region within the wellbore;

(ii) actively generating a first acoustic signal only in response to the production fluid from the first annular region flowing through the first inflow control tool;

(iii) detecting the first acoustic signal; and (iv) distinguishing the first acoustic signal from a second acoustic signal, wherein the second acoustic signal is actively generated only in response to the production fluid from a second annular region flowing through a second inflow control tool disposed in the second annular region within the wellbore.

17. The method of claim 16, further comprising generating a report indicating that the first acoustic signal was detected and that production fluid was flowing through the first inflow control tool.

18. The method of claim 17, further comprising detecting the second acoustic signal and indicating on the report that the first and second acoustic signals were detected and that production fluid was flowing through the first and second inflow control tools.

19. The method of claim 16, further comprising installing the first and second sound-producing elements in the wellbore such that each one of the first and second sound-producing elements is operable to actively generate one of the respective first and second acoustic signals in response to fluid flowing through the respective corresponding one of the first and second inflow control tools.

20. An inflow control tool monitoring system for use with fluid flow in conjunction with a wellbore extending into a subterranean formation, the inflow control tool monitoring system comprising:

an inflow control tool operable to be disposed in the wellbore and operable to regulate fluid flow through the wellbore, the inflow control tool comprising:

an inflow control tool housing, the inflow control tool housing being operable to be installed in line with production tubing;

a restrictive passage within the inflow control tool housing, the restrictive passage operable to regulate the fluid flow; and, a sound-producing element disposed within the inflow control tool housing, the sound-producing element operable to generate a first acoustic signal in response to fluid flow through the inflow control tool, and the sound-producing element not producing sound in response to fluid in the production tubing flowing from sources other than the inflow control tool housing.

21. The inflow control monitoring system of claim 20 further comprising a distributed sensing subsystem, the distributed sensing subsystem being capable of monitoring the first acoustic signal.

22. The inflow control monitoring system of claim 21 wherein the sensing subsystem comprises a measurement device and an optical waveguide.

23. The inflow control monitoring system of claim 20 wherein the inflow control tool is selected from the group consisting of helical type, valve type, nozzle type and combinations of the same.

24. The inflow control monitoring system of claim 20 wherein the sound-producing element is mounted to an interior wall of the inflow control tool housing.

25. The inflow control monitoring system of claim 20 wherein the inflow control tool further comprises a sleeve disposed within the inflow control tool housing, the inflow control tool being valve type, and sound-producing element being mounted to an interior wall of the sleeve.

* * * * *